United States Patent [19]

Zimmer et al.

[11] Patent Number: 4,944,814

[45] Date of Patent: Jul. 31, 1990

[54] ALUMINUM-MANGANESE-IRON STEEL ALLOY

[75] Inventors: James M. Zimmer, Beaver, Pa.; William D. Bailey, Regina, Canada

[73] Assignee: Ipsco Enterprises, Inc., Wilmington, Del.

[21] Appl. No.: 401,093

[22] Filed: Aug. 31, 1989

Related U.S. Application Data

[63] Continuation-in-part of Ser. No. 162,876, Mar. 2, 1989, abandoned, which is a continuation-in-part of Ser. No. 34,485, Apr. 2, 1987, abandoned.

[51] Int. Cl.[5] ..... C22C 38/04; C22C 38/06

[52] U.S. Cl. ..... 148/329; 420/72

[58] Field of Search ..... 148/329; 420/72

[56] References Cited

U.S. PATENT DOCUMENTS 3,111,405 11/1963 Cairns et al. ..... 420/72
3,193,384 7/1965 Richardson ..... 420/72

FOREIGN PATENT DOCUMENTS 655824 1/1963 Canada .
876458 8/1961 United Kingdom .

OTHER PUBLICATIONS

Banerji, "The 1982 Status Report on Fe-Mn-Al Steels," Research and Development, Oct. 1, 1982, p. 6.
Casteletti et al., "Mechanical Properties of an Austenitic Steel of the System Fe-Mn-Al," Depart. Material Sciences, Brazil, University of Sao Paulo, Jul. 5-10, 1981.
S. K. Banerji; "An Update on Fe-Mn-Al Steels", Jun. 11, 1981, published by Foote Mineral Co., Route 100, Exton, Pa. 19341.
J. W. Holladay; "Review of Developments Iron Aluminum Base Alloys", Jan. 30, 1961, Defense Metals Information Center, Battelle Memorial Institute, Columbus, Ohio.
L. D. Casstelletti and D. Spinelli; "The Resistance to Oxidation and the Electrical Resistivity of an Fe-Mn-Al System Alloy", Univ. of Sao Paulo, Sao Carlos, Brazil; Proc. XXXVI, Brazilian Society of Metals Annual Contress, Jul. 5-10, 1981.
A. J. Bushinelli et al., "Study of Microstructural Transformations in TIG Welding of an Fe-Al-Mn Alloy", Federal University of Santa Catarina, Florianapolis, Brazil, ibed, p. 251.
K. Narasimha et al., "An Evaluation of Al-Mn-C Austenitic Steel", submitted to Journal of Metals AIME, Warrendale, Pa.
G. S. Krivonogova et al., "Phase Transformation Kinetics in Steel 9G28Yu9MVB", Physics of Metals and Metallography (4), pp. 86-92, 1975.
V. P. Batrokov et al., "State of the Surface Layer and Corrosion Resistance of Steel 9G28Yu9MVB", Prot. Metl., 10 (5), p. 487, 1974.
M. F. Alekessenko et al., "Phase Composition, Structure, and Properties of Low Density Steel 9G28Yu9MVB", Metal Science and Heat Treatment 14 (3-4), p. 187, 1972.

*Primary Examiner*—Deborah Yee
*Attorney, Agent, or Firm*—Workman, Nydegger & Jensen

[57] ABSTRACT

An austenitic steel alloy has a composition of about 6 to 13 percent aluminum, 20 to 34 percent manganese, 0.2 to 1.4 percent carbon, 0.4 to 1.3 percent silicon, and the balance essentially iron. The relative quantities of the foregoing elements are selected from these ranges to produce a volume percent of ferrite structure in the alloy in the range of about 1 percent to about 8 percent. The volume percent of ferrite is determined by the empirical formula $$1 < VPF = 32 + 2.6(Al\ \% \pm 0.08) + 5.2(Si\ \% \pm 0.03) - 1.6\ (Mn\ \% \pm 0.16) - 8.5\ (C\ \% \pm 0.03) < 8$$

Excluded from the range of alloys of this invention are alloys of the composition (30±1) % Mn, (9±0.35) % Al, (1±0.05) % Si and (1±0.05) % C, with the balance being iron.

12 Claims, No Drawings

ALUMINUM-MANGANESE-IRON STEEL ALLOY

RELATED APPLICATION

This application is a continuation-in-part of application Ser. No. 162,876, filed Mar. 2, 1989, now abandoned, which is a continuation-in-part of application Ser. No. 034,485, filed Apr. 2, 1987, now abandoned.

FIELD OF THE INVENTION

This invention relates to the economical production of high strength, lightweight, low density, iron-manganese-aluminum alloys with all alloying elements balanced to result in a selectably controlled ratio of ferritic to austenitic structure.

BACKGROUND OF THE INVENTION

It is known that iron-manganese-aluminum alloys can provide steels with austenitic structure, having the desirable characteristics of low density, resistance to oxidation, and high strength plus superior cold ductility for ready formability and toughness in service. Iron-manganese-aluminum alloys including small quantities of additional alloying elements are described in U.S. Pat. Nos. 3,111,405 (Cairns et al.) and 3,193,384 (Richardson).

However, the production of alloys of this general character having suitable properties and hot-workability to allow economical manufacture on conventional steel mill facilities requires control of the resulting cast alloy crystal structure, i.e. the relative proportions of body-centered (ferritic) crystal structure and face-centered (austenitic) crystal structure in the alloy must be present within a specified range to ensure that the alloys can be hot rolled with good yield to a useful product. These alloys are expected to find application primarily in plate, sheet and strip form. The hot rolling of these product forms makes this control of the proportions of ferrite and austenite particularly critical, owing to the high speeds and high rates of deformation encountered in commercial mill operations.

The ferrite-austenite ratio in austenitic steel alloys is of critical importance to the final properties of a steel alloy, and is itself dependent upon the elemental composition of the alloy. Thus, while a high aluminum content is desirable in these steel alloys to impart both superior oxidation resistance and a lower density, the aluminum concentrations required, in order to contribute significantly to those objectives, tend to result in a ferritic structure that is not readily hot-worked by conventional methods to produce marketable products. Further, a high aluminum steel product may exhibit limited formability, so that its usefulness in fabricating engineering structures is limited. It is known that the addition of manganese and carbon compensates for these inadequacies of aluminum and promotes the conversion of the ferritic structure to an austenitic structure, resulting in superior hot workability at conventional hot rolling temperatures, as well as ensuring the improved qualities of formability, ductility, and toughness arising from the austenitic structure.

Early investigations of iron-manganese-aluminum alloys have recognized the enhancement of properties that can be achieved by increasing the proportion of austenite structure in such products, providing recipes for such alloys but no indication as to how the ferriteaustenite ratio may be controlled by judicious selection of the elemental composition.

S. K. Banerji in his publication "An Update on Fe-Mn-Al Steels", 11 June, 1981 disclosed a useful alloy composition 30% Mn, 9% Al, 1% Si, 1% C, the balance Fe, but has not taught any range of useful alloy compositions encompassing the foregoing, nor any useful quantitative relationship between volume percent ferrite and the element percentage values selected, nor any preferred range of volume percent ferrite.

The applicants have found that precise control of the ratio of the ferritic volume to austenitic volume is critical to the successful hot rolling of iron-manganese-aluminum alloys. It has been found that a maximum of about 8 percent of the ferrite crystal structure form is compatible with economical and efficient hot rolling of the alloy. A level of ferrite in excess of this proportion causes the workpiece to develop surface tears and "pulls", usually requiring scrapping of the product. Hertofore, the problems presented by an alloy composition having too great a proportion of ferrite structure have been addressed by the use of decreased hot rolling temperatures, but that solution comes only at the expense of increased rolling costs and rolling loads on the mill equipment. Further, the hot rolling temperature limits the final minimum size or thickness of the hot rolled product, so that with higher ferrite alloys additional cold reductions are required to obtain the requisite product sizes, with concomitant added cost and complexity in the production process.

On the other hand, if an iron-manganese-aluminum alloy having purely austenitic crystal structure forms during the solidification of a cast ingot or slab, the casting has been found to result in the development of enlarged grains during the solidification process. Again, the consequence is poor hot workability. During hot rolling, the edges of the workpiece develop irregular tears and fissures to a degree that severe edge loss is encountered in the coil or sheet, resulting in costly yield loss and in strips, sheets or coils too narrow for the intended market. For this reason, a number of hitherto available austenitic steels having too low a ferrite crystal structure have been unamenable to the modern and cost-beneficial process of continuous casting of slabs.

Attempts have been made to remedy the problems resulting from too little ferrite by extraordinary control of the casting temperature and/or lower rolling temperatures to minimize the grain size of the casting and the enlargement of the grains during heating for rolling. However, as a practical matter, such extraordinary control requirements are seriously detrimental to good productivity and, even at best, have proved only marginally successful in preventing yield losses and offsize product.

SUMMARY OF THE INVENTION

The present invention provides a substantially austenitic steel alloy having a predetermined volume percent of ferrite structure lying in the range of about 1 percent to about 8 percent. The alloy comprises by weight 6 to 13 percent aluminum, 20 to 34 percent manganese, 0.2 to 1.4 percent carbon, 0.4 to 1.3 percent silicon, the balance comprising iron. Preferred ranges of these elements are: 6 to 12 percent aluminum, 23 to 31 percent manganese, 0.4 to 1.2 percent carbon and 0.4 to 1.3 percent silicon. The volume percent of ferrite (VPF) structure in the alloy as a whole is selectively achieved by choosing the relative quantities of elements constituting the alloy according to the formula $1<VPF=32+2.6(Al\ \%)+5.2(Si\ \%)-1.6(Mn\ \%)-8.5(C\ \%)<8$ where Al %, Si %, Mn %, and C % are selected percentages by weight of aluminum, silicon, manganese, and carbon, respectively present in the alloy and where VPF is the volume percent of ferrite structure. Other impurities present in small quantities will have an insignificant effect on the foregoing formula. Additional residual elements such as chromium, nickel, molybdenum, copper and other minor impurities may be present up to 0.5 percent, and phosphorus up to about 0.11 percent. These levels of residual elements will have no appreciable undesirable effect on the volume percent ferrite calculated according to the foregoing formula.

The foregoing formula should be applied not exactly but rather within analytical tolerances which take into account the expected analytical variability in determining the composition of the alloys. An empirical version of the foregoing formula duly taking into account tolerances is as follows:

$$1\,VPF=32+2.6(Al\ \%\pm0.08)+5.2(Si\ \%\pm0.03)-1.6(Mn\ \%\pm0.16)-8.5(C\ \%\pm0.03)<8$$

where all the symbols are as previously defined.

Excluded from applicant's range of alloys is the specific alloy disclosed in a paper by Samir K. Banerji, dated 11 June, 1981, entitled "An Update on Fe-Mn-Al Steels" and presented at the workshop on Conservation and Substitution Technology for Critical Materials held at Vanderbilt University, Nashville, Tennessee in June of 1981. That specific alloy, which appears at page 14 of Mr. Banerji's paper, contains 30% Mn, 9% Al, 1% Si and 1% C, with the balance iron. There is no disclosure by Mr. Banerji of any preferred range of volume percent ferrite nor is there any disclosure of the relationship between volume percent ferrite and the specific amounts of alloying ingredients added. However, Mr. Banerji's prior disclosure does constitute a pin-point disclosure of a specific alloy that, were it not for the exclusion, would fall within applicant's preferred range. To give Mr. Banerji the benefit of some degree of tolerance, the exclusion from the scope of the present invention may be considered to be (30±1)% Mn, (9±0.35)% Al, (1±0.05)% Si, and (1±0.05)% C. Based on the reference work R.W.K. Honeycombe "Steels, Microstructure and Properties" (1981), at pages 214–216, alloys falling outside the foregoing tolerances could not be predictably expected to give an acceptable ferrite value.

Although steel alloys are known which contain aluminum, silicon, manganese and iron in weight ranges similar to the ranges of each of these elements required for the present invention, (see, for example, U.S. Pat. No. 3,193,384 to Richardson), the prior art does not teach the making of alloys in which the relative proportions of these elements is selected from within these ranges so as to control the ferrite-austenite ratio. Alloys made in accordance with the present invention must satisfy two requirements: (1) the weight percent of aluminum, manganese, carbon and silicon must lie in the specified ranges; and, at the same time, (2) the weight percentages of these elements must satisfy the above-stated formula.

Where it is desired that the alloys made in accordance with the present invention also have the characteristic of good weldability, the lower limit for VPF is 2 instead of 1, the foregoing formula being otherwise unchanged.

The present invention accordingly provides a basis for selecting suitable austenitic steel alloys at relatively low cost. These alloys have low density and high strength as compared with most prior austenitic steel alloys, and at the same time have characteristics of good formability and hot workability, permitting fabrication by currently available industrial methods.

To this end, the invention provides a formula for specifying the elemental composition of iron-manganese-aluminum alloys so that the relative proportions of ferritic and austenitic structure permit commercial production at reasonable cost by established practices on conventional plant equipment. Such low density, high strength, ductile alloys can be readily melted, cast and rolled to produce forms and sizes for use in the fabrication of steel products.

DETAILED DESCRIPTION OF THE INVENTION

It has been found that by control of the ferriteaustenite ratio in steels of the composition under consideration, so that the volume percent of ferrite crystal structure lies in the range of about 1 percent to about 8 percent, a very "forgiving" steel composition can be produced, which accepts both cold and hot rolling without generating the kinds of problems encountered in the prior art.

In order to study the relationship between elemental composition and the ferrite-austenite ratio, a number of small laboratory heats were melted and cast with a range of compositions as shown in Table 1 below.

TABLE 1

| | Composition Percent | | | | |
|---|---|---|---|---|---|
| Melt No. | C | Mn | Si | Al | VPF % |
| 1232 | .99 | 27.8 | 1.43 | 9.4 | 13.0 |
| 1295 | .99 | 28.6 | 1.43 | 9.7 | 12.7 |
| 1413 | .92 | 29.7 | 1.22 | 6.9 | 2.3 |
| 1455 | .85 | 29.1 | 1.20 | 7.7 | 2.6 |
| 1456 | .94 | 29.7 | 1.07 | 9.6 | 10.8 |
| 1563 | .82 | 34.4 | 1.30 | 10.7 | 4.1 |
| 1568 | 1.03 | 28.5 | .93 | 10.2 | 25.0 |
| 1667A | .63 | 29.3 | .75 | 9.0 | 13.6 |
| 1667B | .63 | 28.9 | .76 | 9.5 | 16.4 |
| 1667C | .63 | 29.0 | .75 | 10.0 | 15.5 |
| 1667D | .63 | 28.8 | .74 | 10.6 | 7.7 |
| 1667E | .62 | 29.3 | .75 | 10.9 | 13.4 |
| 1668A | .68 | 29.0 | .75 | 9.8 | 11.8 |
| 1668B | .68 | 28.8 | .75 | 10.1 | 8.7 |
| 1668C | .67 | 28.6 | .74 | 10.9 | 3.9 |
| 1668D | .67 | 28.2 | .74 | 11.1 | 6.3 |
| 1668E | .66 | 28.2 | .74 | 11.6 | 9.7 |
| 1671A | .90 | 28.2 | .41 | 9.8 | 6.1 |
| 1671B | .90 | 28.1 | .41 | 10.1 | 5.4 |
| 1671C | .90 | 27.9 | .40 | 10.7 | 9.3 |
| 1671D | .88 | 27.9 | .40 | 11.1 | 12.6 |
| 1671E | .90 | 27.7 | .40 | 11.5 | 17.8 |
| 1774A | .71 | 28.6 | .70 | 9.9 | 7.6 |
| 1774B | .71 | 28.0 | .69 | 10.6 | 10.9 |
| 1774C | .68 | 27.9 | .69 | 10.9 | 11.2 |
| 1774D | .71 | 27.9 | .69 | 11.6 | 9.7 |
| 1774E | .71 | 27.8 | .68 | 12.5 | 15.1 |
| 1775A | .69 | 27.0 | .30 | 10.9 | 13.9 |
| 1775B | .70 | 28.1 | .54 | 10.9 | 14.5 |
| 1775C | .71 | 29.3 | .88 | 10.7 | 9.6 |
| 17741 | .66 | 25.5 | .66 | 10.2 | 17.3 |
| 17742 | .58 | 25.2 | .66 | 9.9 | 16.4 |
| 17743 | .74 | 27.9 | .66 | 9.6 | 8.3 |
| 17752 | .77 | 27.2 | .29 | 7.0 | 1.8 |
| 17753 | .73 | 26.5 | .29 | 9.9 | 10.1 |
| 1825 | .55 | 27.4 | .48 | 11.7 | 7.9 |
| 1826 | .61 | 27.9 | .49 | 11.7 | 5.6 |
| 1880A | .81 | 29.5 | .32 | 7.9 | 0 |

TABLE 1-continued

| Melt No. | Composition Percent C | Mn | Si | Al | VPF % |
|---|---|---|---|---|---|
| 1881A | .76 | 29.3 | .34 | 7.5 | 0.7 |
| 1881B | .76 | 29.3 | .75 | 7.5 | 2.0 |
| 1881C | .75 | 28.9 | 1.19 | 7.5 | 1.4 |
| 1881D | .76 | 28.6 | 1.19 | 7.3 | 4.6 |
| 1882A | .82 | 29.1 | .54 | 9.8 | 2.6 |
| 1882D | .81 | 28.8 | .54 | 9.6 | 2.8 |
| 1882E | 1.06 | 29.5 | .54 | 9.2 | 1.6 |
| 1882F | 1.24 | 29.3 | .56 | 9.2 | 1.7 |

The elements and the composition ranges of the elements selected to produce the data of Table 1 were chosen based upon studies reported in the literature and on the effects of these elements on the critical properties of density, strength, oxidation resistance, formability and weldability. The heats were either 50 or 70 kg in weight, cast into approximately 3½Δ or 5Δ square ingots, respectively. Samples cast simultaneously with the ingots were analyzed for composition and studied microscopically. Magnetic measurements were made for determination of the volume percent ferrite (VPF) resulting from the various compositions. The ingots were generally hot rolled to a thickness of about 0.25 inches on a laboratory mill equipped to allow measurement of the rolling energy requirements of the various alloys. Selected heats were further cold rolled to 0.10 inch thickness. Some of the compositions melted could not be hot rolled because of the presence of excess ferrite. Heating temperatures for these operations were in the range of 1560° F. (850° C.) to 2150° F. (1175° C.). No difficulty was encountered in hot working heats having a VPF in the range of 1 percent to 8 percent.

By analysis of composition data from Table 1 and the corresponding measurements of VPF of the individual alloys, a relationship was ascertained on the basis of which a quantitative prediction of VPF can be made as a linear function of the weight percentages of carbon, manganese, silicon, and aluminum in the alloys as follows:

$$1 < VPF = 32 + 2.6(Al\ \%) + 5.2(Si\ \%) - 1.6(Mn\ \%) - 8.5(C\ \%) < 8$$

where Al %, Si %, Mn %, and C % are selected percentages by weight of aluminum, silicon, manganese, and carbon, respectively present in said alloy, the balance of composition of said alloy being essentially iron, and where VPF is the volume percent of ferrite structure. This equation relates the independent composition variables to the dependent variable of the volume fraction of ferrite to be found in or near the surface of an as-cast section of the alloy such as an ingot or cast slab that has been cooled without undue delay to below 600° F. (315° C.). The applicant has found that alloys can be made having an acceptable level of ferrite, as calculated from the aforementioned formula, and which at the same time have composition levels of individual elements that do not go beyond known alloying restraints. These restraints require the weight percent of the alloying elements to be selected from the following ranges: 6 to 13 percent aluminum, 20 to 34 percent manganese, 0.2 to 1.4 percent carbon, and 0.4 to 1.3 percent silicon. Within these ranges, the following narrower ranges are preferred: 6 to 12 percent aluminum, 23 to 31 percent manganese, 0.4 to 1.2 percent carbon, and 0.4 to 1.3 percent silicon. The proportions of these alloying elements are computed according to the aforementioned formula to result in between 1 percent and 8 percent VPF in an otherwise austenitic crystal structure.

The manufacture of alloys according to the invention commences with the calculation of a composition according to the above formula to ensure that an acceptable level of ferrite is present in the crystal structure. Within the constraints imposed by that formula, the composition is also controlled to achieve the desired characteristics of density, strength, toughness, formability and oxidation resistance.

Manganese concentrations in excess of about 30 percent tend to cause the formation of embrittling beta manganese phase. Carbon in excess of about 1.0 percent has been shown to have a detrimental effect on corrosion resistance. Silicon in excess of about 1.3% has been found to result in cracking during rolling. These additional known restraints and limitations upon the contributions to alloy composition of particular elements are indicated here to illustrate the effects influencing the design of useful alloys, but are not intended to be exclusive of other effects taught in the literature or other prior art.

Owing to the exceptionally high manganese content required in these alloys, the only reasonable economic source of manganese is the common ferromanganese alloys. These ferro alloys characteristically contain maximum phosphorus levels of the order of 0.30 to 0.35 percent. Since it is impractical to remove phosphorus during melting in this alloy system, the resulting iron-manganese-aluminum alloys melted with these raw materials will have levels of phosphorus in the range of 0.030 to 0.110 percent by weight, typical levels being about 0.045 to 0.055 percent. These levels of phosphorus have an insignificant effect on the aforementioned formula. Alloys according to the invention may also contain small amounts of other elements as a consequence of the raw materials used in commercial melting.

When a composition of alloy have been selected to achieve the desired ferrite-austenite ratio in accordance with the calculation above, the melt is heated up to about 2550° F. to 2650° F. (1400° C. to 1450° C.) at which temperature the alloy is molten. Alloys according to the invention can be melted by standard techniques, such as by the electric arc or induction furnace method, and may be optionally further processed through any of the "second vessel" practices used in conventional stainless steel making.

The alloy is poured into an ingot mould and permitted to cool at ambient temperature for two and one-half to three hours in order to solidify. Solidification commences at just above 2490° F. (1365° C.) and is complete at about 2170° F. (1190° C.), the exact temperatures of melting and solidification being dependent upon the elemental composition. The mould is then stripped from the ingot and the ingot may be further cooled or charged hot for reheating to be further worked as required. Alternatively, alloys according to the invention can be continuously cast to slabs on conventional machines and reheated and hot rolled according to usual industry practices.

Alloys according to the present invention present none of the phase change problems which have characterized earlier compositions. As long as the ferrite percentage as described above is kept within the range of about 1 percent to about 8 percent, the ingot can be hot worked and the coil product cold worked without adverse results. Hot rolling of these alloys can be readily accomplished on mills conventionally used for the processing of austenitic steels. However, the lower melting point resulting from the higher total alloy content of compositions according to the invention must be recognized in the selection of a heating temperature for the ingots or slabs. Typically, 2150° F. (1175° C.) has proved satisfactory for the alloys within the preferred ranges of the composition constraints of the invention.

Alloys according to the invention can be successfully cold rolled if desired and tend to behave in response to temperature conditioning as do conventional austenitic steels.

As stated above, it has been found that alloys made in accordance with the present invention, having a VPF between 1 and 8, have good hot rollability. It has also been found that the weldability (i.e. spot-, resistance- or arc-welding) of such alloys is also dependent on the VPF. In particular, adverse weldability effects have been found where the VPF is outside the range between about 2 and 12. Thus, where good weldability is desired as a characteristic of alloys made in accordance with this invention, the VPF should be controlled within a range of between 2 and 8, values of 2 or less being unsatisfactory for weldability and values of 8 and over being unsatisfactory for hot rollability. The foregoing formula is used in the selection of the proportions of alloying elements, but the lower limit for VPF is 2 instead of 1.

What is claimed is:

1. A substantially austenitic steel alloy having a predetermined volume percent of ferrite structure in the range of about 1 percent to about 8 percent, said alloy comprising by weight 6 to 13 percent aluminum, 20 to 34 percent manganese, 0.2 to 1.4 percent carbon, 0.4 to 1.3 percent silicon, and the balance comprising iron, wherein the proportions of the elements alloyed with iron selected from the said ranges satisfy the formula $$1 < VPF = 32 + 2.6(Al\ \% \pm 0.08) + 5.2(Si\ \% \pm 0.03) - 1.6(Mn\ \% + 0.16) - 8.5(C\ \% + 0.03) < 8$$

or substantial metallurgical equivalent thereof, where Al %, Si %, Mn % and C % are selected percentages by weight of aluminum, silicon, manganese and carbon respectively present in said alloy, and where VPF is the volume percent of ferrite structure; and wherein the proportions of the elements alloyed with iron are selected to exclude the following composition:

(30±1)% Mn, (9±0.35)% Al, (1±0.05)% Si and (1±0.05)% C, with the balance being iron.

2. A substantially austenitic steel alloy having a predetermined volume percent of ferrite structure in the range of about 1 percent to about 8 percent, said alloy comprising by weight 6 to 12 percent aluminum, 23 to 31 percent manganese, 0.4 to 1.2 percent carbon, 0.4 to 1.3 percent silicon, and the balance comprising iron, wherein the proportions of the elements alloyed with iron selected from the said ranges satisfy the formula $$1 < VPF = 32 + 2.6(Al\ \% \pm 0.08) + 5.2(Si\ \% \pm 0.03) - 1.6(Mn\ \% \pm 0.16) - 8.5(C\ \% \pm 0.03) < 8$$

or substantial metallurgical equivalent thereof, where Al %, Si %, Mn % and C % are selected percentages by weight of aluminum, silicon, manganese and carbon respectively present in said alloy, and where VPF is the volume percent of ferrite structure; and wherein the proportions of the elements alloyed with iron are selected to exclude the following composition:

(30±1)% Mn, (9±0.35)% Al, (1±0.05)% Si and (1±0.05)% C, with the balance being iron.

3. A method of making a substantially austenitic steel alloy predictably having a predetermined volume percent of ferrite structure in the range of about 1 percent to about 8 percent and predictably capable of hot rolling and formability, comprising the steps of:

(a) selecting proportions of aluminum, manganese, carbon and silicon to satisfy the formula $$1 < VPF = 32 + 2.6(Al\ \% \pm 0.08) + 5.2(Si\ \% \pm 0.03) - 1.6(Mn\ \% \pm 0.16) - 8.5(C\ \% \pm 0.03) < 8$$

or substantial metallurgical equivalent thereof, where Al %, Si %, Mn % and C % are selected percentages by weight of aluminum, silicon, manganese and carbon respectively, and where VPF is the volume percent of ferrite structure, the said percentages by weight being selected from the ranges of 6 to 13 percent aluminum, 20 to 34 percent manganese, 0.2 to 1.4 percent carbon, 0.4 to 1.3 percent silicon, the balance of the alloy comprising iron, and further selecting the proportions of aluminum, manganese, carbon and silicon, so as to exclude alloys comprising (30±1)% Mn, (9±0.35)% Al, (1±0.05)% Si and (1±0.05)% C, with the balance being iron, and (b) alloying the selected proportions of aluminum, silicon, manganese, carbon and iron.

4. A method according to claim 3, wherein the said percentages by weight of aluminum, manganese, carbon and silicon are selected from the ranges 6 to 12 percent aluminum, 23 to 31 percent manganese, 0.4 to 1.2 percent carbon, and 0.4 to 1.3 percent silicon, respectively.

5. A substantially austenitic steel alloy having a predetermined volume percent of ferrite structure in the range of about 2 percent to about 8 percent, said alloy comprising by weight 6 to 13 percent aluminum, 20 to 34 percent manganese, 0.2 to 1.4 percent carbon, 0.4 to 1.3 percent silicon, and the balance comprising iron, wherein the proportions of the elements alloying with iron selected from the said ranges satisfy the formula $$2 < VPF = 32 \pm 2.6(Al\ \% \pm 0.08) + 5.2(Si\ \% \pm 0.03) - 1.6(Mn\ \% \pm 0.16) - 8.5(C\ \% \pm 0.03) < 8$$

or substantial metallurgical equivalent thereof, where Al %, Si %, Mn % and C % are selected percentages by weight of aluminum, silicon, manganese and carbon respectively present in said alloy, and where VPF is the volume percent of ferrite structure; and wherein the proportions of the elements alloyed with iron are selected to exclude the following composition:

(30±1)% Mn, (9±0.35)% Al, (1±0.05)% Si and (1±0.05)% C, with the balance being iron.

6. A substantially austenitic steel alloy having a predetermined volume percent of ferrite structure in the range of about 2 percent to about 8 percent, said alloy comprising by weight 6 to 12 percent aluminum, 23 to 31 percent manganese, 0.4 to 1.2 percent carbon, 0.4 to 1.3 percent silicon, and the balance comprising iron, wherein the proportions of the elements alloying with iron selected from the said ranges satisfy the formula $$2 < VPF = 32 + 2.6(Al\ \% + 0.08) + 5.2(Si\ \% + 0.03) - 1.6(Mn\ \% \pm 0.16) - 8.5(C\ \% \pm 0.03) < 8$$

or substantial metallurgical equivalent thereof, where Al %, Si %, Mn % and C % are selected percentages by weight of aluminum, silicon, manganese and carbon respectively present in said alloy, and where VPF is the volume percent of ferrite structure; and wherein the proportions of the elements alloyed with iron are selected to exclude the following composition:

(3±1)% Mn, (9±0.35)% Al, (1±0.05)% Si and (1±0.05)% C, with the balance being iron.

7. A method of making a substantially austenitic steel alloy predictably having a predetermined volume percent of ferrite structure in the range of about 2 percent to about 8 percent and predictably capable of hot rolling, weldability and formability, comprising the steps of:

(a) selecting proportions of aluminum, manganese, carbon and silicon to satisfy the formula $$2<VPF=32+2.6(Al\ \%+0.08)+5.2(Si\ \%\pm0.03)-1.6(Mn\ \%\pm0.16)-8.5(C\ \%\pm0.03)<8$$

or substantial metallurgical equivalent thereof, where Al %, Si %, Mn % and C % are selected percentages by weight of aluminum, silicon, manganese and carbon respectively, and where VPF is the volume percent of ferrite structure, the said percentages by weight being selected from the ranges of 6 to 13 percent aluminum, 20 to 34 percent manganese, 0.2 to 1.4 percent carbon, 0.4 to 1.3 percent silicon, the balance of the alloy comprising iron, and further selecting the proportions of aluminum, manganese, carbon and silicon, so as to exclude alloys comprising (30±1)% Mn, (9±0.35)% Al, (1±0.05)% Si and (1±0.05)% C, with the balance being iron, and (b) alloying the selected proportions of aluminum, silicon, manganese, carbon and iron.

8. A method according to claim 3, wherein the said percentages by weight of aluminum, manganese, carbon and silicon are selected from the ranges 6 to 12 percent aluminum, 23 to 31 percent manganese, 0.4 to 1.2 percent carbon, and 0.4 to 1.3 percent silicon, respectively.

9. A method of making a substantially austenitic steel alloy predictably having a predetermined volume percent of ferrite structure in the range of about 1 percent to about 8 percent and predictably capable of hot rolling and formability, comprising the steps of:

(a) selecting proportions of aluminum, manganese, carbon and silicon to satisfy the formula $$1<VPF=32+2.6(Al\ \%\pm0.08)+5.2(Si\ \%+0.03)-1.6(Mn\ \%\pm0.16)-8.5(C\ \%\pm0.03)<8$$

or substantial metallurgical equivalent thereof, where Al %, Si %, Mn % and C % are selected percentages by weight of aluminum, silicon, manganese and carbon respectively, and where VPF is the volume percent of ferrite structure, the said percentages by weight being selected from the ranges 6 to 13 percent aluminum, 20 to 34 percent manganese, 0.2 to 1.4 percent carbon, 0.4 to 1.3 percent silicon, the balance of the alloy comprising iron, and further selecting the proportions of aluminum, manganese, carbon and silicon, so as to exclude alloys comprising (30±1)% Mn, (9±0.35)% Al, (1±0.05)% Si and (1±0.05)% C;

(b) alloying in a melt the selected proportions of aluminum, silicon, manganese, carbon and iron;

(c) pouring the steel into a mold; and (d) stripping the mold from the steel when the steel is still at least red hot and permitting the steel to cool at ambient temperature.

10. A method according to claim 9, wherein the said percentages by weight of aluminum, manganese, carbon and silicon are selected from the ranges 6 to 12 percent aluminum, 23 to 31 percent manganese, 0.4 to 1.2 percent carbon, and 0.4 to 1.3 percent silicon, respectively.

11. A method of making a substantially austenitic steel alloy predictably having a predetermined volume percent of ferrite structure in the range of about 2 percent to about 8 percent and predictably capable of hot rolling, weldability and formability, comprising the steps of:

(a) selecting proportions of aluminum, manganese, carbon and silicon to satisfy the formula $$2<VPF=32+2.6(Al\ \%\pm0.08)+5.2(Si\ \%+0.03)-1.6(Mn\ \%\pm0.16)-8.5(C\ \%\pm0.03)<8$$

or substantial metallurgical equivalent thereof, where Al %, Si %, Mn % and C % are selected percentages by weight of aluminum, silicon, manganese and carbon respectively, and where VPF is the volume percent of ferrite structure, the said percentages by weight being selected from the ranges 6 to 13 percent aluminum, 20 to 34 percent manganese, 0.2 to 1.4 percent carbon, 0.4 to 1.3 percent silicon, the balance of the alloy comprising iron, and further selecting the proportions of aluminum, manganese, carbon and silicon, so as to exclude alloys comprising (30±1)% Mn, (9±0.35)% Al, (1±0.05)% Si and (1±0.05)% C;

(b) alloying in a melt the selected proportions of aluminum, silicon, manganese, carbon and iron;

(c) pouring the steel into a mold; and (d) stripping the mold from the steel when the steel is still at least red hot and permitting the steel to cool at ambient temperature.

12. A method according to claim 11, wherein the said percentages by weight of aluminum, manganese, carbon and silicon are selected from the ranges 6 to 12 percent aluminum, 23 to 31 percent manganese, 0.4 to 1.2 percent carbon, and 0.4 to 1.3 percent silicon, respectively.

* * * * *

UNITED STATES PATENT AND TRADEMARK OFFICE
CERTIFICATE OF CORRECTION

PATENT NO. : 4,944,814

DATED : July 31, 1990

INVENTOR(S) : JAMES M. ZIMMER et al.

It is certified that error appears in the above-identified patent and that said Letters Patent is hereby corrected as shown below:

Cover page, line 1, under heading "Related U.S. Application Data," "Mar. 2, 1989" should be --Mar. 2, 1988--

Column 1, line 6, "Mar. 2, 1989" should be --Mar. 2, 1988--

Column 2, line 10, "Hertofore" should be --Heretofore--

Column 3, line 2, there should be no spaces between "(Al" and "%)" and between "(Si" and "%)"

Column 3, in the equation following line 21, "1VPF" should be --1<VPF--

Column 4, first two lines after the heading "DETAILED DESCRIPTION OF THE INVENTION," change "ferriteaustenite" to be --ferrite-austenite--

Column 5, line 18, "3½▲ or 5▲" should be --3½" or 5"--

Column 7, line 40, in the first line of the equation, "5.2(Si" should read --5.2(Si%--

Column 7, line 41, in the second line of the equation, "(Mn% + 0.16)" should be --(Mn% ± 0.16)--; and correct "(C% + 0.03)" should be --(C% ± 0.03)--

Column 8, line 45, in the first line of the equation, "32 ± 2.6" should be --32 + 2.6--

Column 8, in the equation at lines 66 and 67, correct "(Al% + 0.08)" to read --(Al% ± 0.08)--; and correct "(Si% + 0.03)" to read --(Si% ± 0.03)--

Column 9, line 8, correct "(3 ± 1)%" to read --(30 ± 1)%--

Column 9, in the first line of the equation at line 19, correct "(Al% + 0.08)" to read --(Al% ± 0.08)--

UNITED STATES PATENT AND TRADEMARK OFFICE

CERTIFICATE OF CORRECTION

'ATENT NO. : 4,944,814

)ATED : July 31, 1990

NVENTOR(S) : JAMES M. ZIMMER et al.

It is certified that error appears in the above-identified patent and that said Letters Patent is hereby :orrected as shown below:

Column 9, in the second line of the equation at line 50, "% + 0.03" should be --% ± 0.03)--

Column 10, in the second line of the equation at line 30, "% + 0.03)" should be --% ± 0.03)--

Signed and Sealed this

Fifteenth Day of September, 1992

*Attest:*

*Attesting Officer*

DOUGLAS B. COMER

*Acting Commissioner of Patents and Trademarks*